United States Patent [19]

Frangatos

[11] 4,159,960

[45] Jul. 3, 1979

[54] LUBRICANT COMPOSITIONS

[75] Inventor: Gerassimos Frangatos, Cherry Hill, N.J.

[73] Assignee: Mobil Oil Corporation, New York, N.Y.

[21] Appl. No.: 793,014

[22] Filed: May 2, 1977

[51] Int. Cl.[2] ..... C10M 1/10

[52] U.S. Cl. ..... 252/49.9

[58] Field of Search ..... 252/49.9, 58

[56] References Cited

U.S. PATENT DOCUMENTS

| | | | |
|---|---|---|---|
| 2,236,915 | 4/1941 | Norton | 252/49.9 |
| 2,289,509 | 7/1942 | Malisoff | 252/49.9 |
| 2,371,631 | 3/1945 | Lincoln et al. | 252/49.9 |
| 2,656,373 | 10/1953 | Gamrath | 252/49.9 |
| 2,866,806 | 12/1958 | Markley et al. | 252/49.9 |
| 2,933,449 | 4/1960 | Moreton | 252/49.9 |
| 2,942,588 | 6/1960 | Rudel et al. | 252/58 |
| 3,287,266 | 11/1966 | Southern et al. | 252/49.9 |
| 3,591,506 | 7/1971 | Peeler | 252/49.9 |
| 3,640,857 | 2/1972 | Schneider et al. | 252/49.9 |

FOREIGN PATENT DOCUMENTS

| | | | |
|---|---|---|---|
| 663382 | 5/1963 | Canada | 252/49.9 |

OTHER PUBLICATIONS

Davey, "Industrial & Engineering Chemistry," Extreme Pressure Lubricants, Sep. 1950, pp. 1841-1847.

Buehler et al., *Survey of Org. Synthesis,* 1970, pp. 361-362.

*Primary Examiner*—Delbert E. Gantz

*Assistant Examiner*—Andrew Metz

*Attorney, Agent, or Firm*—Charles A. Huggett; Raymond W. Barclay; Claude E. Setliff

[57] ABSTRACT

The antiwear and load carrying properties of lubricants are improved by incorporating therein a product prepared by reacting a trihydrocarbyl phosphate with a methallyl halide and a halogen.

8 Claims, No Drawings

LUBRICANT COMPOSITIONS

BACKGROUND OF THE INVENTION

1. Field of the Invention

The invention relates to lubricants having desirable antiwear and load carrying properties. It more particularly relates to improving such properties by adding a small amount of methallylhalide and halogen - phosphate reaction product.

2. Description of the Prior Art

Lubricants are subject to heavy stresses that can affect their antiwear and load carrying ability. Thus, there has been considerable effort to discover classes of compounds that will aid in retaining or, preferably, in improving these important properties.

For example, sulfur compounds have been used for the purpose, as is taught in U.S. Pat. No. 3,697,499. Unfortunately, the presence of sulfur in lubricants may cause severe metal corrosion, especially copper. To overcome this, special processes have been used to moderate the effect of sulfur, as in U.S. Pat. No. 3,697,499, or other materials have been used, among them certain phosphorus compounds, as lubricant additives. U.S. Pat. No. 3,663,439, for instance, discloses lubricating oils whose extreme pressure properties have been improved by adding thereto a reaction product involving a trihydrocarbyl phosphate.

SUMMARY OF THE INVENTION

The invention provides a lubricant composition comprising lubricant and an antiwear amount of a product prepared by reacting a trihydrocarbyl phosphate with methallyl halide and halogen to yield a product containing halide ions from said methallyl halide and halogen.

The trihydrocarbyl phosphate useful in this invention will have the formula:

$$(RO)_3P{=}O$$

where R may be the same or different and is a hydrocarbyl group containing from 1 to about 20 carbon atoms. Preferred are the lower alkyl groups, i.e., those having 1 to 6 carbon atoms. Also included are those containing aryl groups, e.g., phenyl, naphthyl and anthryl and the alkyl-substituted members, the alkyl containing 1 to 6 carbon atoms. Specifically, the useful reactants include the trimethyl, triethyl, tributyl, trihexyl, trioctyl, tridecyl, trianthryl, tritolyl and tri(alkylphenyl) phosphates.

It is not known precisely what product is produced but it seems likely that at least some of the product is formed in accordance with the following generalized scheme:

where R has the above meaning. It will be understood that the presentation of the phosphate structure here is not a disclosure that the product made has such a definite structure. While it is believed that at least a part of the product formed is a phosphate, the total structure of the additive is much more complex than is indicated by the above scheme. For instance, the compounds of II could yield polymerizable vinyl monomers (III) through the reaction shown.

Useful products can be made by reacting from about 1 mole to about 2 moles of methallyl halide (e.g., the chloride, bromide, iodide or fluoride) and from about 1 mole to about 2 moles, preferably 1 mole, of halogen (e.g., bromine, chlorine, iodine and fluorine), preferably bromine, with one mole of trihydrocarbyl phosphate. The temperature of reaction will range from about −5° C. to about 80° C., preferably about −5° C. to about 25° C., depending upon the reactants used. Also, the reaction times will vary between about 1 hour to about four hours, preferably between about 1 to about 2, again depending upon the particular reactants chosen. The final reaction product will normally have a molecular weight of from about 290 to about 725 and will contain a total of from about 5% to about 24% of halide and from 4% to about 10% of phosphorus, both by weight.

In carrying out the reaction, a solvent may or may not be used. If it is used, criteria for selecting it include solubility of the reactants and products therein and ease of removal from the final product.

The lubricants which are improved by the reaction products of this invention are mineral and synthetic lubricating oils and greases therefrom. The mineral oils will be understood to include not only the paraffinic members, but also the naphthenic members. By synthetic oils are meant synthetic hydrocarbons, polyalkylene oxide oils, polyacetals, polysilicones and the like, as well as synthetic ester oils. Included among the latter type are those esters made from monohydric alcohols and polycarboxylic acids, such as 2-ethylhexylazelate and the like. Also included are those esters made from polyhydric alcohols and aliphatic monocarboxylic acids. Those of this group are especially important and in this group are found esters prepared from (1) the trimethylols, such as the ethane, propane and butane derivatives thereof and 2,2-disubstituted propane diols and (2) the pentaerythritols reacted with aliphatic monocarboxylic acids containing from about 4 to 9 carbon atoms. Mixtures of these acids may be used to prepare the esters. Preferred among the esters are those made from pentaerythritol and a mixture of $C_5$–$C_9$ acids.

As has been indicated, the reaction products disclosed herein are useful as antiwear and load carrying agents. When so used, they may be added in amounts

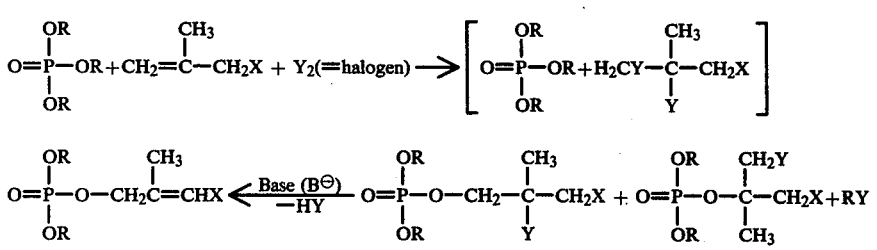

III II I sufficient to impart such properties to the lubricant. Generally, the useful amount will range from about 0.25% to about 10% by weight, preferably from about 1% to about 5%, of the product.

Having discussed the invention in broad and general terms, the following are offered to illustrate it. It is to be understood that the Examples are merely illustrative and are not intended to limit the scope of the invention.

EXAMPLE 1

Trimethyl phosphate (140g, 1.0 mole) was dissolved in 200ml of petroleum ether. The solution was cooled to −5° C. in a methanol-ice cooling mixture. 80g (0.5 mole) of bromine and 90.5g (1.0 mole) of methallyl chloride were added dropwise and simultaneously into the cooled phosphate-ether solution, while stirring and cooling. The solvent was stripped off under reduced pressure up to 100° C., leaving 265.0g of product.

EVALUATION OF THE PRODUCTS

The product of Example 1 was tested in the 4-Ball Test using a modified 4-Ball machine. In this test, three stationary balls are placed in a lubricant cup and a lubricant containing the additive to be tested is added thereto. A fourth ball is placed on a chuck mounted on a device which can be used to spin the ball at known speeds and loads.

In this test 100 cc of a lubricating oil comprising an 80–20 mixture, respectively, of 150″ solvent paraffinic bright mineral oil (at 210° F.) and 200″ solvent paraffinic neutral mineral oil (at 100° F.) was used. It contained 1.0% by weight of the product of Example 1. The following table summarizes the results.

TABLE I

| Temperature | Room Temperature | | | | 200° F. | | | | 390° F. | | | |
|---|---|---|---|---|---|---|---|---|---|---|---|---|
| RPM | 500 | 1000 | 1500 | 2000 | 500 | 1000 | 1500 | 2000 | 500 | 1000 | 1500 | 2000 |
| Load, Kg | 60 | 60 | 60 | 60 | 60 | 60 | 60 | 60 | 60 | 60 | 60 | 60 |
| Time, min. | 30 | 30 | 30 | 30 | 30 | 30 | 30 | 30 | 30 | 30 | 30 | 30 |
| Average Scar Diameter, mm | | | | | | | | | | | | |
| Horizontal 1 | 0.40 | 0.60 | 0.70 | 0.80 | 0.70 | 0.80 | 0.80 | 0.80 | 0.70 | 0.90 | 0.80 | 0.80 |
| 2 | 0.40 | 0.60 | 0.70 | 0.80 | 0.70 | 0.80 | 0.80 | 0.80 | 0.70 | 0.90 | 0.80 | 0.80 |
| 3 | 0.40 | 0.60 | 0.70 | 0.80 | 0.70 | 0.80 | 0.80 | 0.80 | 0.70 | 0.90 | 0.80 | 0.80 |
| Vertical 1 | 0.40 | 0.60 | 0.80 | 0.80 | 0.70 | 0.80 | 0.90 | 0.80 | 0.70 | 0.90 | 0.70 | 0.80 |
| 2 | 0.40 | 0.60 | 0.80 | 0.80 | 0.70 | 0.80 | 0.90 | 0.80 | 0.70 | 0.90 | 0.70 | 0.80 |
| 3 | 0.40 | 0.60 | 0.80 | 0.80 | 0.70 | 0.80 | 0.90 | 0.80 | 0.70 | 0.90 | 0.70 | 0.80 |
| Final Average | 0.40 | 0.60 | 0.75 | 0.80 | 0.70 | 0.80 | 0.85 | 0.80 | 0.70 | 0.90 | 0.75 | 0.80 |
| Untreated Oil | | | | | | | | | | | | |
| Average Scar Diameter, mm | | | | | | | | | | | | |
| Final Average | 0.50 | 0.60 | 0.88 | 2.34 | 0.60 | 1.06 | 1.86 | 2.23 | 1.00 | 1.31 | 2.06 | 1.98 |

I claim:

1. A lubricant composition comprising a mineral oil, synthetic oil or greases thereof and an antiwear amount of a product prepared by reacting from about 1 mole to about 2 moles of a methallyl halide and from about 1 to about 2 moles of a halogen with one mole of a trialkyl phosphate containing 1 to 6 carbon atoms, the reaction being carried out at from about −5° C. to about 80° C., the product containing from about 5% to about 24% of halide and from about 4% to about 10% of phosphorus, all by weight.

2. The composition of claim 1 in which the halide is chloride and halogen is bromine.

3. The composition of claim 2 in which said product contains a total of from about 5% to about 24% by weight of halide.

4. The composition of claim 1 in which the trihydrocarbyl phosphate is a trialkyl phosphate, the alkyl group containing from 1 to 6 carbon atoms.

5. The composition of claim 4 in which the trialkyl phosphate is trimethyl phosphate.

6. The composition of claim 1 wherein said halide is the chloride, said halogen is bromine and said trihydrocarbyl phosphate is triethyl phosphate.

7. The composition of claim 1 wherein said lubricant is a mineral lubricating oil or a grease therefrom.

8. The composition of claim 1 wherein said lubricant is a synthetic lubricating oil or a grease therefrom.

* * * * *